US010368596B2

(12) United States Patent
Aso

(10) Patent No.: US 10,368,596 B2
(45) Date of Patent: Aug. 6, 2019

(54) FIRST METACARPAL SLING FOR BALL GLOVE

(71) Applicant: Wilson Sporting Goods Co., Chicago, IL (US)

(72) Inventor: Shigeaki Aso, Hoffman Estates, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 413 days.

(21) Appl. No.: 14/951,187

(22) Filed: Nov. 24, 2015

(65) Prior Publication Data

US 2017/0144055 A1 May 25, 2017

(51) Int. Cl.

| | |
|---|---|
| ***A63B 71/14*** | (2006.01) |
| ***A41D 19/015*** | (2006.01) |
| *A63B 69/00* | (2006.01) |

(52) U.S. Cl.

CPC . *A41D 19/01582* (2013.01); *A41D 19/01523* (2013.01); *A41D 19/01547* (2013.01); *A41D 19/01588* (2013.01); *A63B 71/143* (2013.01); *A63B 2069/0011* (2013.01); *A63B 2225/09* (2013.01)

(58) Field of Classification Search

CPC ..... A63B 71/14; A63B 71/141; A63B 71/143; A63B 19/01582

See application file for complete search history.

(56) References Cited

U.S. PATENT DOCUMENTS

| | | | | |
|---|---|---|---|---|
| 2,434,171 | A * | 1/1948 | Latina | A63B 71/143 2/19 |
| 3,994,024 | A * | 11/1976 | Bates | A63B 71/143 2/19 |
| 4,065,813 | A * | 1/1978 | Hudson | A63B 71/143 2/162 |
| 4,346,481 | A * | 8/1982 | Latina | A63B 71/143 2/19 |
| 4,541,127 | A * | 9/1985 | Gould | A63B 71/143 2/161.1 |
| 4,891,845 | A * | 1/1990 | Hayes | A63B 71/143 2/161.1 |
| 4,937,882 | A * | 7/1990 | Hayes | A63B 71/143 2/162 |
| 5,457,819 | A * | 10/1995 | Aoki | A63B 71/143 2/161.1 |
| 5,659,897 | A * | 8/1997 | Satoh | A63B 71/143 2/16 |
| 5,678,245 | A | 10/1997 | Rector et al. | |
| 5,694,642 | A | 12/1997 | Rector et al. | |
| 6,347,402 | B1 * | 2/2002 | Aoki | A63B 71/143 2/19 |

(Continued)

*Primary Examiner* — Richale L Quinn

(74) *Attorney, Agent, or Firm* — Terence P. O'Brien; Todd A. Rathe

(57) ABSTRACT

A ball glove for catching the ball includes a front glove portion, a back glove portion coupled to the front glove portion to define a hand cavity having a thumb stall. The thumb stall has a back side and a palm side. A metacarpal sling extends within the hand cavity. The sling extends from a thumb side of the back glove portion to a pinky side of the back glove portion and continuing along the back side of the thumb stall to the palm side of the thumb stall so as to support the first metacarpal on a person's hand when the person's hand is positioned within the hand cavity.

20 Claims, 7 Drawing Sheets

(56) References Cited

U.S. PATENT DOCUMENTS

| | | | | |
|---|---|---|---|---|
| 6,553,571 | B1 | 4/2003 | Guenther et al. | |
| 6,634,029 | B1 * | 10/2003 | Sullivano | A63B 71/143 2/19 |
| 6,681,401 | B1 | 1/2004 | Marino | |
| 6,766,531 | B2 * | 7/2004 | Sullivano | A63B 71/143 2/19 |
| 2015/0165302 | A1 | 6/2015 | Jaramillo et al. | |

* cited by examiner

FIRST METACARPAL SLING FOR BALL GLOVE

BACKGROUND

Baseball and softball gloves are worn by players to assist the players in catching balls hit by a batter or thrown by teammate. Ball gloves include a hand cavity to receive a person's hand and form a pocket to facilitate catching of the ball.

DETAILED DESCRIPTION OF EXAMPLES

Figure 1:
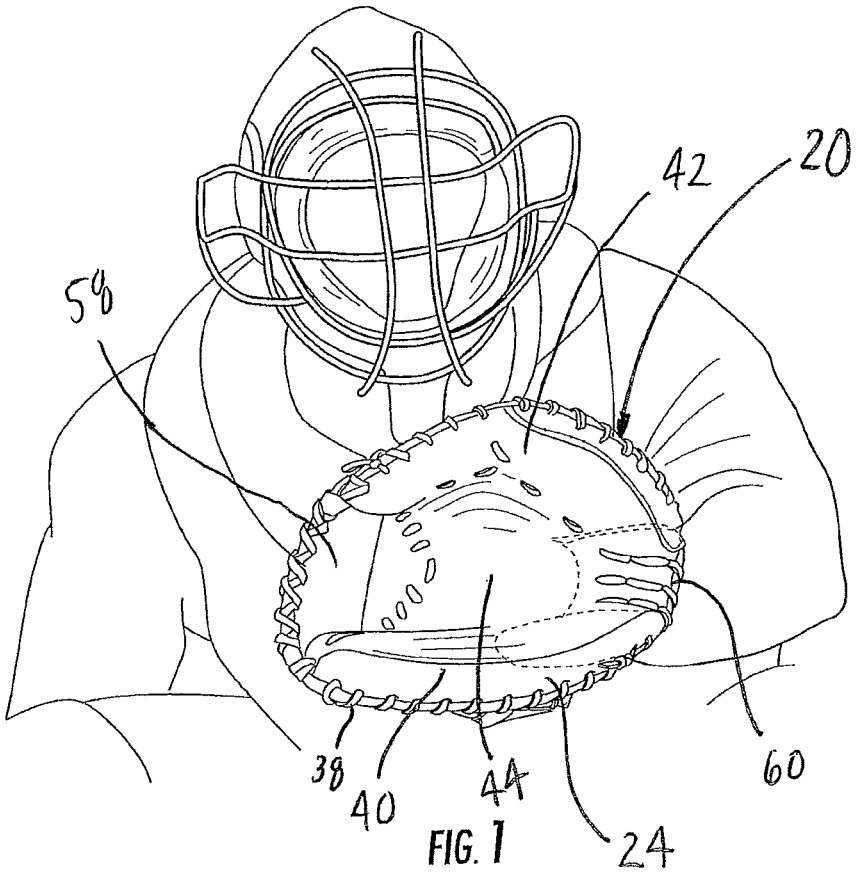
FIG. 1 is a front perspective view illustrating an example ball glove being worn by a catcher.

FIG. 1 illustrates an example ball glove 20 worn by a ballplayer. In the example illustrated, ball glove 20 comprises a catcher's glove or catcher's mitt worn by a catcher awaiting a ball thrown by a pitcher. During a game, the glove 20, as well as the player's hand and wrist, experience large forces resulting from the impact of the ball with the glove. Repeated impact of the ball with the glove can cause strain and fatigue upon the player's hand and wrist, possibly leading to injury. Strain and fatigue can be a particular concern when a catcher repeatedly catches a pitch ball with his or her hand generally in the position shown in FIG. 1, or with the glove tilted slight at the base of the hand or top of the wrist such that the webbing of the catcher's glove or mitt is tilted downward with respect to the user's forearm. Importantly, such a position is common for many catcher's and leads to strain, stress and/or fatigue at the base of the user's hand byt the thumb and wrist of the catcher. As will be described hereafter, glove 20 incorporates a sling which assists in supporting the player's thumb, hand and wrist to reduce strain and fatigue of the player's thumb, hand and wrist.

Figure 2:
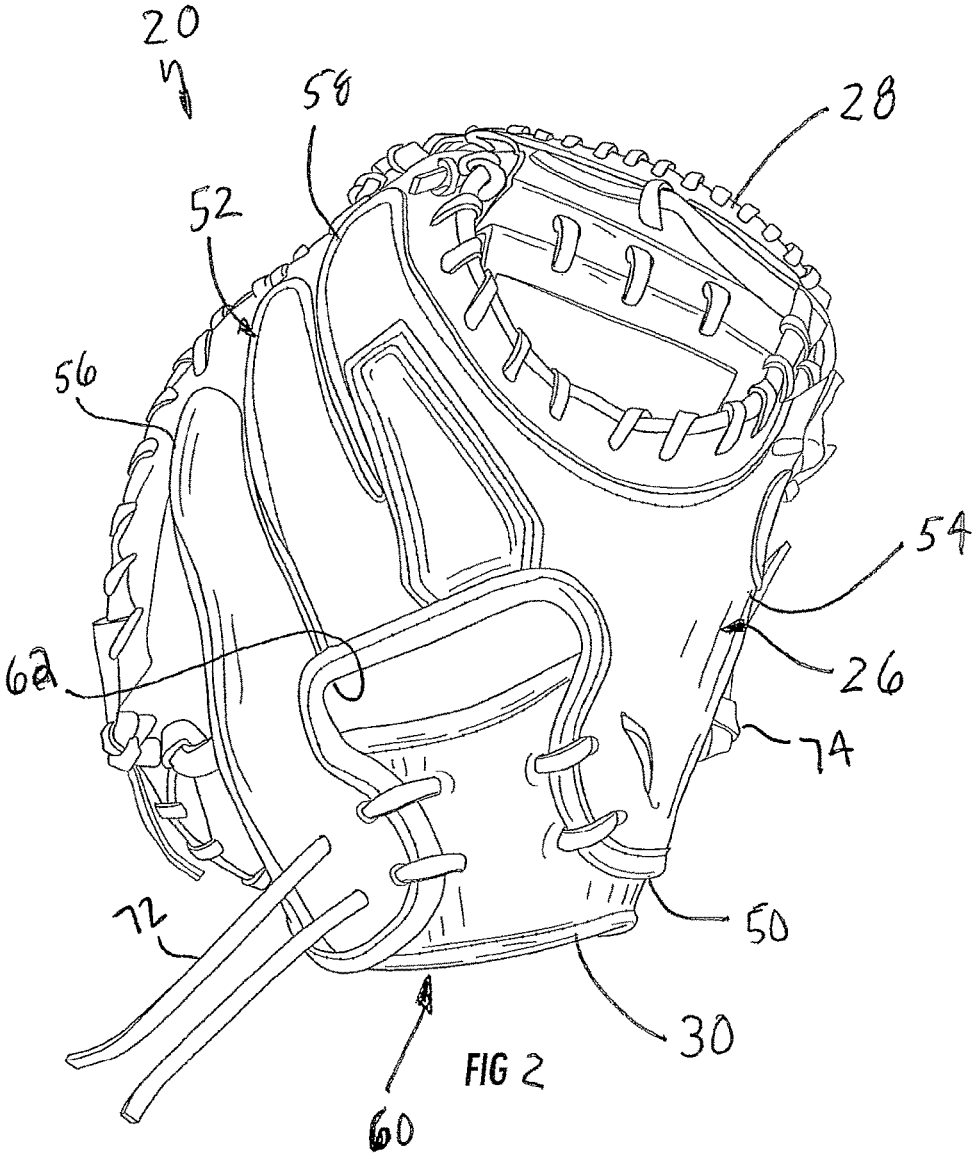
FIG. 2 is a rear perspective view of the glove of FIG. 1.
Figure 3:
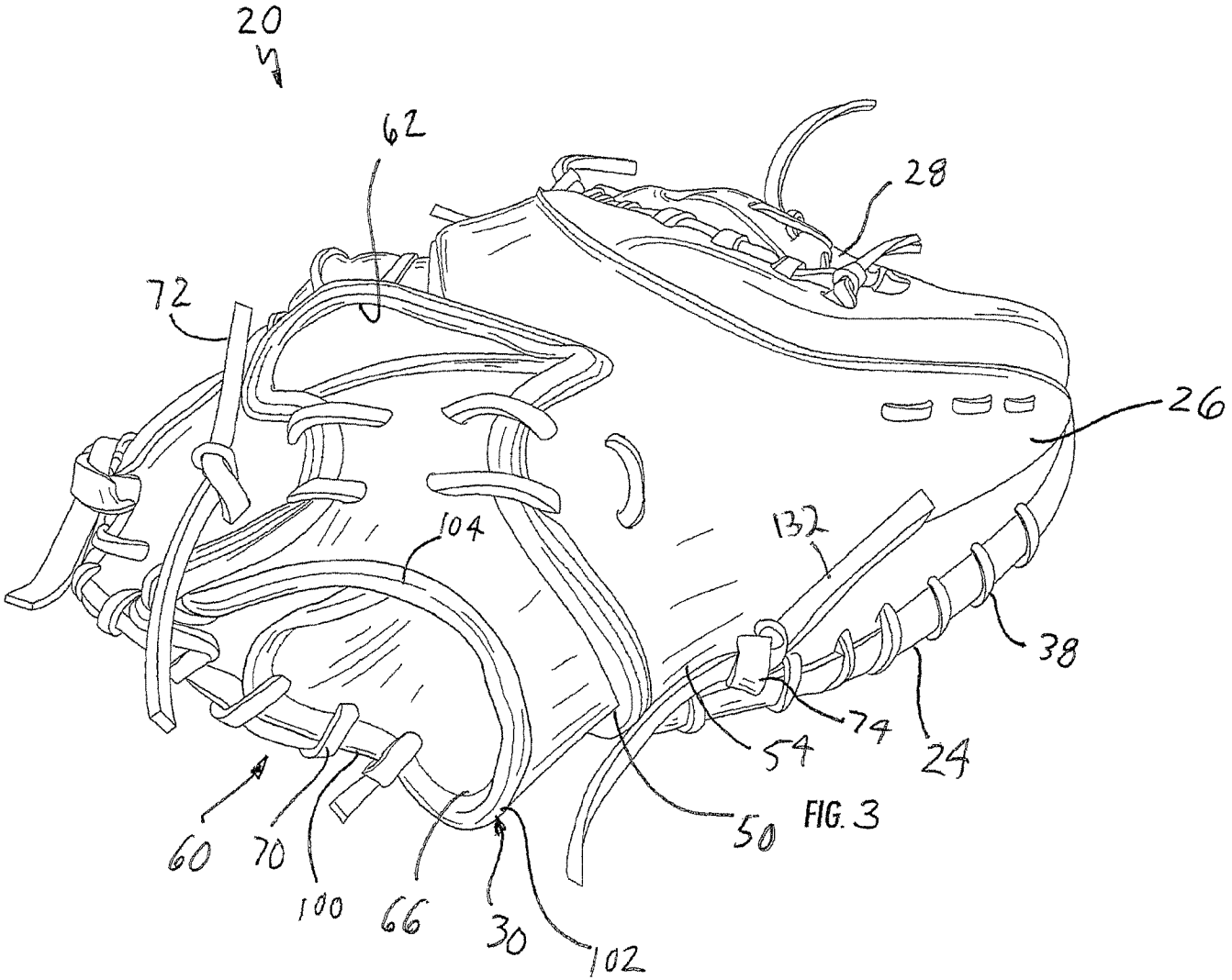
FIG. 3 is a rear end perspective view of the glove of FIG. 1.

FIGS. 1-3 illustrate the various portions of glove 20. As shown by FIG. 1-3, glove 20 comprises front glove portion 24, back glove portion 26, webbing 28 and metacarpal sling 30. Front glove portion 24 and back glove portion 26 are contoured sheet-like structures, each resembling a hand. Front glove portion 24 covers and protects the palm side of the user's hand from impact with the ball. As shown by FIG. 1 which illustrates the example glove 20 as a catcher's mitt, front glove portion 24 comprises an enlarged padded regions 40 projecting beyond the person's thumb and regions 42 projecting beyond a person's pinky finger to collectively encircle or generally surround a formed pocket 44 by greater than 180°.

Back glove portion 26 is joined to front glove portion 24. In the example illustrated, front glove portion 24 and back glove portion are stitched together such as with straps, stitchings, or laces 38. In other implementations, portions 24 and 26 may be connected through other means, such as, for example, weltings, bonding, molding, other fasteners or adhesives, or combinations thereof. In the example illustrated, portions 24 and 26 are made of a pliable, durable and relatively soft material, such as leather. In other implementations, portions 24 and 26 may be formed from other materials, such as, for example, artificial leather, composite leather, rubber, plastic, other polymers and combinations thereof.

Front glove portion 24 and back glove portion 26 are connected together to define a hand cavity 50, one or more finger stalls 52 and a thumb stall 54. Finger stalls 52 and thumb stall 54 comprise elongate cavities adapted for receiving the fingers and thumb of the user or player. In the example illustrated in which the example ball glove 20 comprises a catcher's mitt, back glove portion 26 is joined to front glove portion 24 so as to form less than four finger stalls. In the example illustrated, a single stall 56 is provided for receiving a person's pinky and ring finger. Because glove 20 includes less than four finger stalls, allowing multiple fingers to be received within a single stall, fatigue on the catcher's hand is reduced.

Webbing 26 comprises a generally flat structure that is connected to the front glove portion 24 and the back glove portion 26 between the first finger stall 58 and the thumb stall 54. Webbing 28 provides a region for facilitating catching and securing a ball during play. As shown by FIG. 1, webbing 58 extends adjacent to pocket 24 between padded regions 40 and 42 opposite to the heel portion 60 of glove 20. In one implementation, webbing 26 is formed from a panel of pliable, durable and relatively soft material such as leather. The panel is joined to one or both of portions 24, 26 through stitchings, lacing or the like. In other implementations, webbing 28 may be joined to portions 24 and/or 26 through other means such as laces, weltings, bonding, moldings, adhesives or other fasteners. In some implementations, webbing 28 may be formed as one or more subpanels.

Metacarpal sling 30 comprises a band of material inserted into the hand cavity 50 between portions 24 and 26 proximate heel 60 of glove 20. In one implementation, sling 30 comprises a single panel of material. In another implementation, sling 30 comprises multiple panels joined to one another in an overlapping fashion by stitching, adhesives, fasteners or the like. As will be described hereafter, in some implementations, sling 30 comprises a single panel or multiple panels which support a pad. In the example illustrated, metacarpal sling 30 comprise a band of a pliable, durable and relatively soft material, such as leather. In other implementations, sling 30 may be formed from other materials, such as, for example, one or more felts, padding layers, fabrics, textiles, artificial leather, composite leather, rubber, plastic, other polymers and combinations thereof.

As shown by FIG. 2, back glove portion 26 of the example glove 20 comprises an opening 60 extending from heel 60 towards the fingertips of stalls 52. In the example illustrated, sling 30 extends across or spans opening 60, extending from the region proximate to thumb stall 54, the thumb side of back glove portion 26, to the region proximate to stall 56, the pinky side of back glove portion 26. For purposes of this disclosure, the term "pinky side" means the side of the glove most proximate to the stall of the glove that is to receive the pinky of a person's hand when the hand is inserted into the glove. The term "thumb side" means a side of the glove most proximate to the stall of the glove that is to receive the thumb of a person's hand when the head is inserted into the glove.

As shown by FIG. 3, sling 30 continues along the back side of the thumb stall 54 to the palm side of the thumb stall 54. In the example illustrated, sling 30 is configured, sized or dimensioned so as to wrap about portions of the person's hand adjacent the opponens pollicis extending alongside the first metacarpal along the side of the person's hand between a base of the person's thumb and wrist and the thenar emminence on the palm side of the person's hand between the base of the thumb and the wrist. Sling 30, when secured within hand cavity 50 has a curved or C-shaped profile which forms a secondary hand cavity 66 within hand cavity 50 that receives the person's hand. As a result, when a person is wearing and holding glove 20 in the orientation shown in FIG. 1, sling 30 supports the first metacarpal on the person's hand, proximate a lower portion of a person's wrist, from a suspension point proximate an upper portion of the person's wrist.

In the example illustrated, sling 30 is secured to, connected to or joined to the remainder of glove 20 by lacings 70, 72 and 74. Lacing 70 secure sling 30 to front portion 24 and/or back portion 26 at heel 60. Lacing 72 secure sling 30 to back portion 26, across opening 62. Lacing 74 secure portions of sling 30 to back portion 26 further inward or along thumb stall 54, more proximate to webbing 28. As a result, sling 30 is secured to the remainder of glove 20 at four distinct locations. In other implementations, sling 30 may be joined to remainder of glove 20 at a greater or fewer number of such locations or at other locations. In other implementations, sling 30 may be joined to glove 20 using other means such as lacings, moldings, adhesives, stitchings, other fasteners or combinations thereof.

Figure 4:
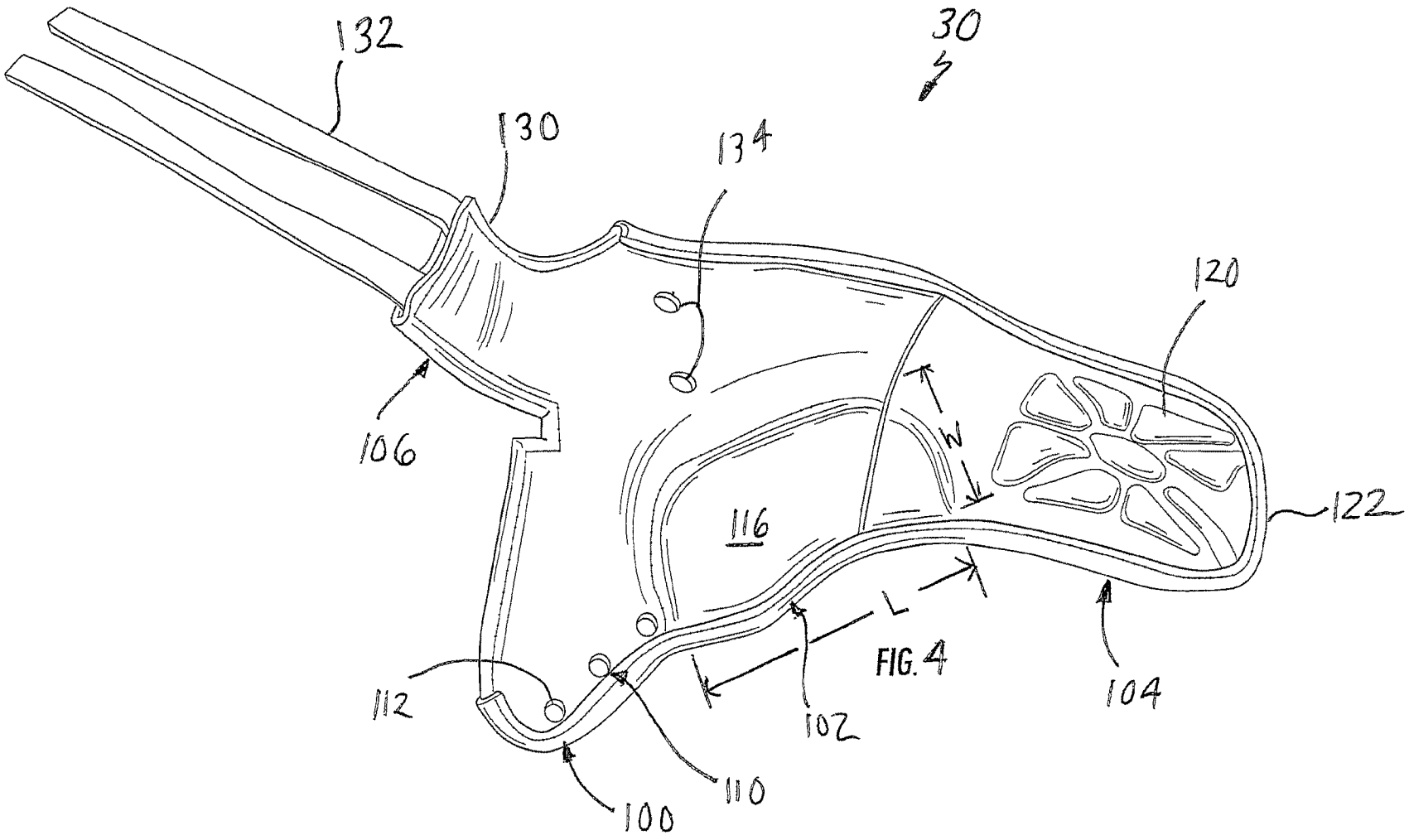
FIG. 4 is a top perspective view of an example sling of the glove of FIG. 1.

FIG. 4 illustrates the example metacarpal sling 30 in more detail. As shown by FIG. 4, metacarpal sling 30 comprises heel securement portion 100, metacarpal support portion 102, wrist extension portion 104 and thumb sleeve portion 106. Heel securement portion 100 comprises a panel, founed from one or more layers, that is to extend along heel 60 of glove 20 when sling 30 is inserted into hand cavity 50. Heel securement portion 100 comprises a mechanism 110 to facilitate the securement or connection of portion 100 to front glove portion 24 of glove 20 along heel 60. In the example illustrated, mechanism 110 comprises openings 212 through which lacing 70 (shown in FIG. 3) are threaded. In other implementations, mechanism 110 may comprise other connectors or connector portions such as stitchings, weltings, buckles, snaps, hooks, hook and loop fasteners or the like for releasable connection to glove 20. In some implementations, portion 100 may be permanently joined are connected to back glove portion 26 and/or front glove portion 24 through stitching, adhesives, molding or the like. For purposes of this disclosure, the term "permanently joined" means that two structures are members are joined to one another such that they cannot be separated and reattached to one another without adding additional fasteners or adhesive and without altering or destroying the original configuration of the connection of the two members as existed prior to such separation.

Metacarpal support portion 102 extends between heel securement portion 100 and wrist extension portion 104. Metacarpal support portion 102 is located and shaped so as to curl and wrap about the first metacarpal of the hand of the person positioned within glove 20. Metacarpal support portion 102 has an inner contacting surface 116 that contacts the skin overlying the opponens pollicis extending alongside the first metacarpal along the side or gloved hand of the person's hand between a base of the person's thumb and wrist and the thenar emminence on the palm side of the person's hand between the base of the thumb and the wrist. Portion 102 forms the band of sling 30 as shown in FIG. 3. In one implementation, portion 102 comprises a greater amount of padding as compared to portion 100. In one implementation, portion 102 has an amount or degree of stiffness (resistance to bending or the formation) greater than the stiffness of portion 100 as well as portion 104. When glove 20 is held in the orientation shown in 1, surface 116 faces upwardly, underlying the lower edge of the hand within glove 20, underlying the first metacarpal and the opponens pollicis.

In one implementation, metacarpal support portion 102 has a length sufficient to completely wrap about the edge of the person's hand along the first metacarpal, from the palm side adjacent the thenar emminence to the back of the person's hand between the base of the thumb and the wrist. In one implementation, metacarpal support portion 102 has a length L of at least 1.5 inches, preferably within a range of 2 to 6 inches. In one implementation, metacarpal support portion 102 has a width W sufficient so as to extend opposite to and underlie a majority (greater than 50%) and, preferably, at least 80% of the distance between the base or proximal end of the person's thumb (the base of the proximal phalanx the thumb or the metacarpal-phalangeal joint crease) and the distal wrist crease of the wrist. The width of metacarpal support portion 102 is provided such that portion 102 or surface 116 does not span or extend across the distal wrist crease of the person's wrist while terminating prior to themetacarpal-phalangeal joint crease. In one implementation, metacarpal support portion 102 has a width of at least 1 inch and, preferably, of at least 1.5 inches. In one implementation, metacarpal support portion 102 has a width within the range of 1 to 3 inches.

Wrist extension portion 104 extends from portion 102 and is configured to extend across opening 62 for connection to the pinky side of back glove portion 26. In the example illustrated, wrist extension portion 104 comprises a padding layer 120 secured to an overlapping the continuous layer the forms the outer surface of sling 30. Wrist extension 104 terminates at an end 122. As shown by FIGS. 2 and 3, wrist extension portion 104 is releasably secured at end 122 to back glove portion 26 on the pinky side of back glove portion 26 by stitching 72. In other implementations, end 122 may be releasably secured to back of portion 26 proximate the pinky side of portion 26 by other connection means such as a hook and loop fastener arrangement, snaps, buttons, hooks or the like.

Figure 5:
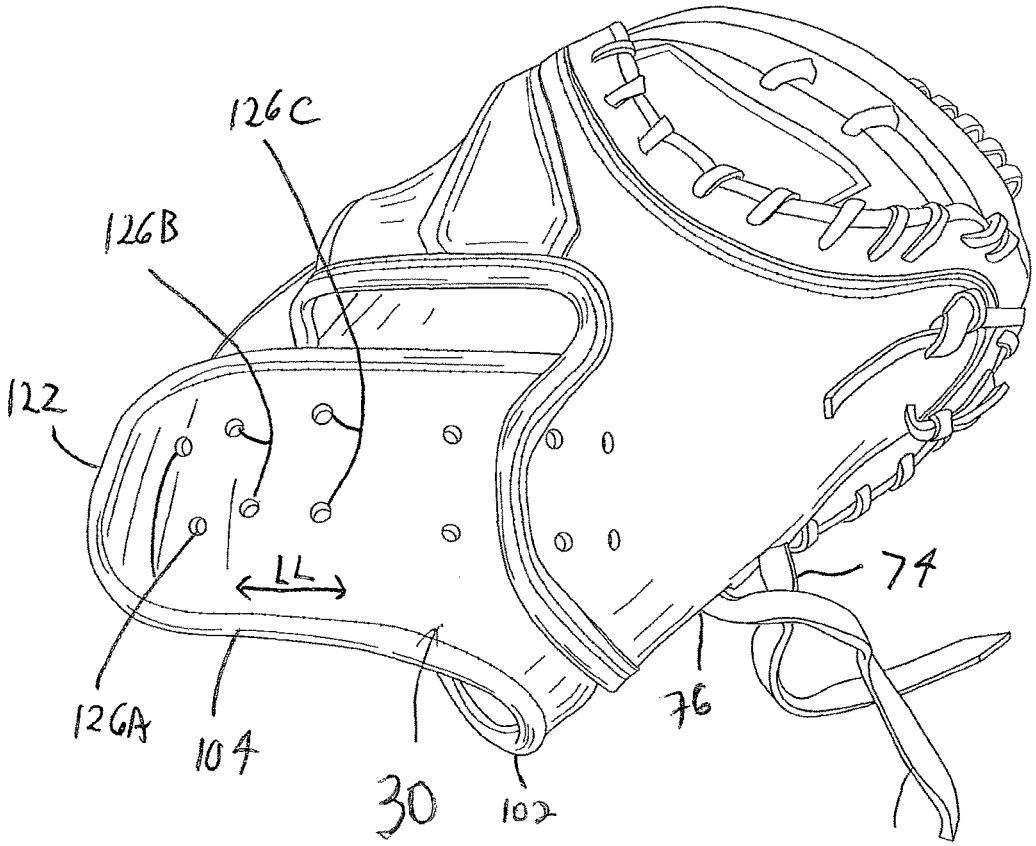
FIG. 5 is a rear perspective view of the glove of FIG. 1 illustrating adjustability of a wrist extension portion of the sling.

As shown by FIG. 5, in some implementations, wrist extension portion 104 may include a plurality of spaced openings or spaced sets of openings 126A, 126B, 126C (collectively referred to as openings 126) extending through a back or outer layer (layer that overlaps or backs padding 120) of wrist extension portion 104. Openings 126 allow a person or user to choose from amongst the available sets of openings for connection of end 122 to the pinky side of back glove portion 26. Openings 126 facilitate adjustable connection of end 122 to the pinky side of back glove portion 26 by welting 72. In such an implementation, the length of wrist extension portion 104 extending across opening 62 may be adjusted to adjust how tightly or loosely wrist extension 104 extends about and over the back side of the person's hand when inserted into glove 20. In other implementations, wrist extension portion 104 may alternatively include other types of connectors spaced from one another in a direction along the longitudinal length LL of portion 104 to facilitate adjustable connection of end 122 to the pinky side of back glove portion 26.

Thumb sleeve portion 106 of sling 30 comprises that portion of sling 30 that is configured to form a thumb sleeve 140 (shown in FIG. 3) within thumb stall 54 for reception of the person's thumb. Thumb sleeve portion 106 comprises flap 130, lacing 74 and openings 134. Flap 130 comprise a portion of the one or more panels forming sling 130 that form an extension or wrap configured to bend or curl into the shape of a cylinder forming thumb sleeve 140. Lacing 74 comprise lines, laces or straps extending from flap 130. Lacing 74 are configured to extend through openings 134 to maintain flap 130 and the curled, cylindrical configuration. In the example illustrated, lacing 74 further extends through openings 76 in back glove portion 26 to further secure sling 130 to back glove portion 26 as shown in FIG. 3. In other implementations, other connectors or fastening arrangements, such as hook and loop fasteners, buttons, clips, snaps, buckles or the like, may be used in lieu of lacing 74 and openings 134. In other implementations, different or separate fastening mechanisms or arrangements may be used to (A) secure flap 130 in the cylindrical thumb sleeve forming configuration and (B) secure sling 30 two back cover portion 26.

In the example illustrated, sling 30, excluding padding 120 and binding 132, is formed from a single continuous layer, panel or sheet of material, such as a single continuous panel or sheet of a pliable, durable and relatively soft material, such as leather, artificial leather, composite leather, rubber, plastic, other polymers and combinations thereof. In the example illustrated, padding 120 is secured as a single panel to wrist extension portion 104. The padding 120 can be formed as a single padding layer with spaced apart padded regions and channels for facilitating air flow over the back of the hand of the user, such as disclosed in U.S. Pat. No. 6,634,029. Binding 122 extends over and secures the edges of wrist extension portion 104. In some implementations, the single continuous panel is folded relative to itself and stitched for multiple layers. In yet other implementations, sling 130 may be formed from multiple sheets or panels joined to one another by stitching, adhesives or fasteners.

In the example illustrated, sling 30 is configured as an upgrade to an existing glove, wherein sling 30 is removably inserted into the existing glove 20 without an existing sling. Such existing glove can have a narrow band that spans across opening 62, terminating before wrapping about the side of the person's hand between the base of the thumb and the wrist. In other implementations, sling 30 may be inserted into the hand cavity of an alternative existing glove that omits opening 62, wherein wrist extension portion 104 extends beyond or within the back glove portion 26 of the alternative glove. In yet other implementations, sling 30 may have one or more portions that are permanently joined to glove 20. Although sling 30 is illustrated as comprising wrist sleeve portion 106, in other implementations, wrist sleeve portion 106 may be omitted from sling 30, either omitted entirely from glove 20 or provided within thumb stall 54 by glove 20 independent of sling 30.

Figure 6:
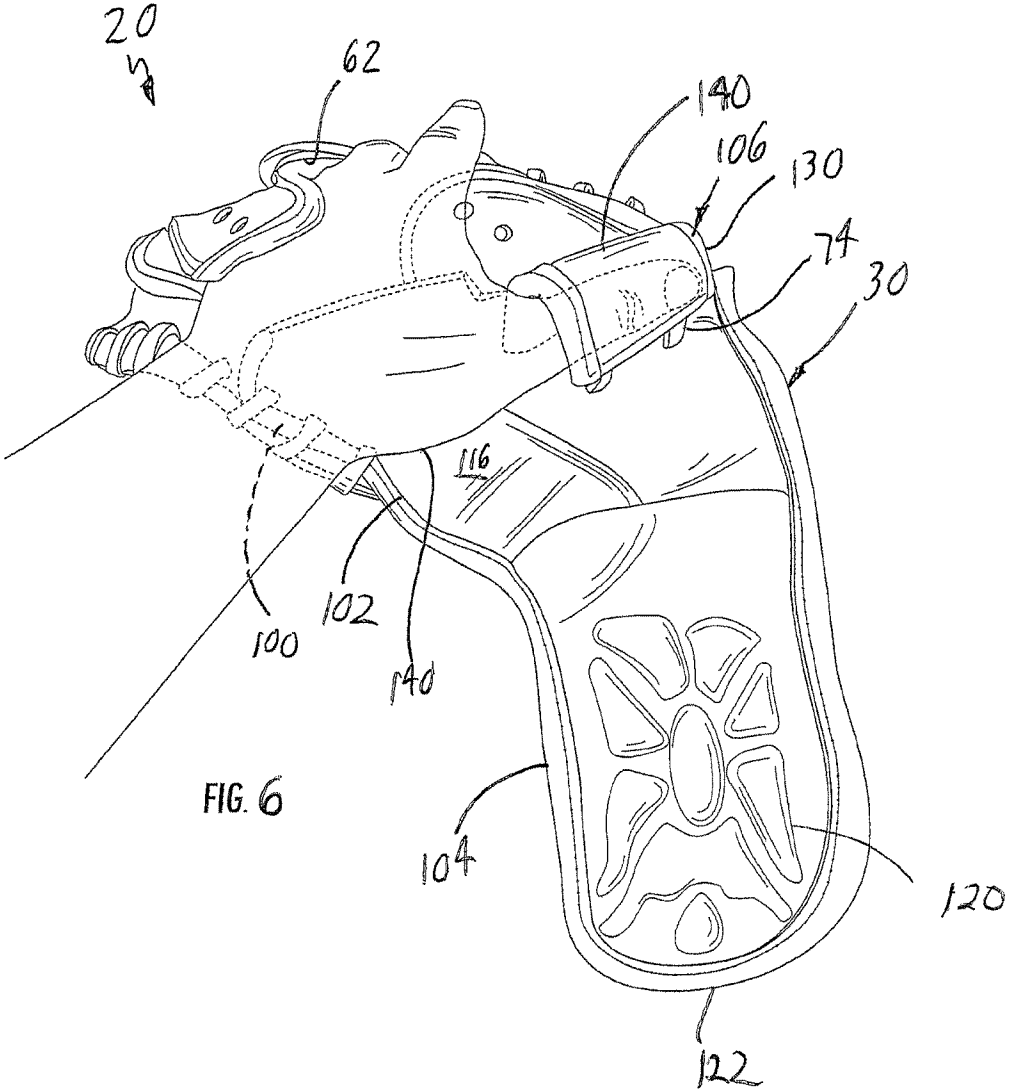
FIG. 6 is a rear perspective view of the glove of FIG. 1 illustrating positioning of the person's hand with respect to the sling with portions of the glove omitted for purposes of illustration.
Figure 7:
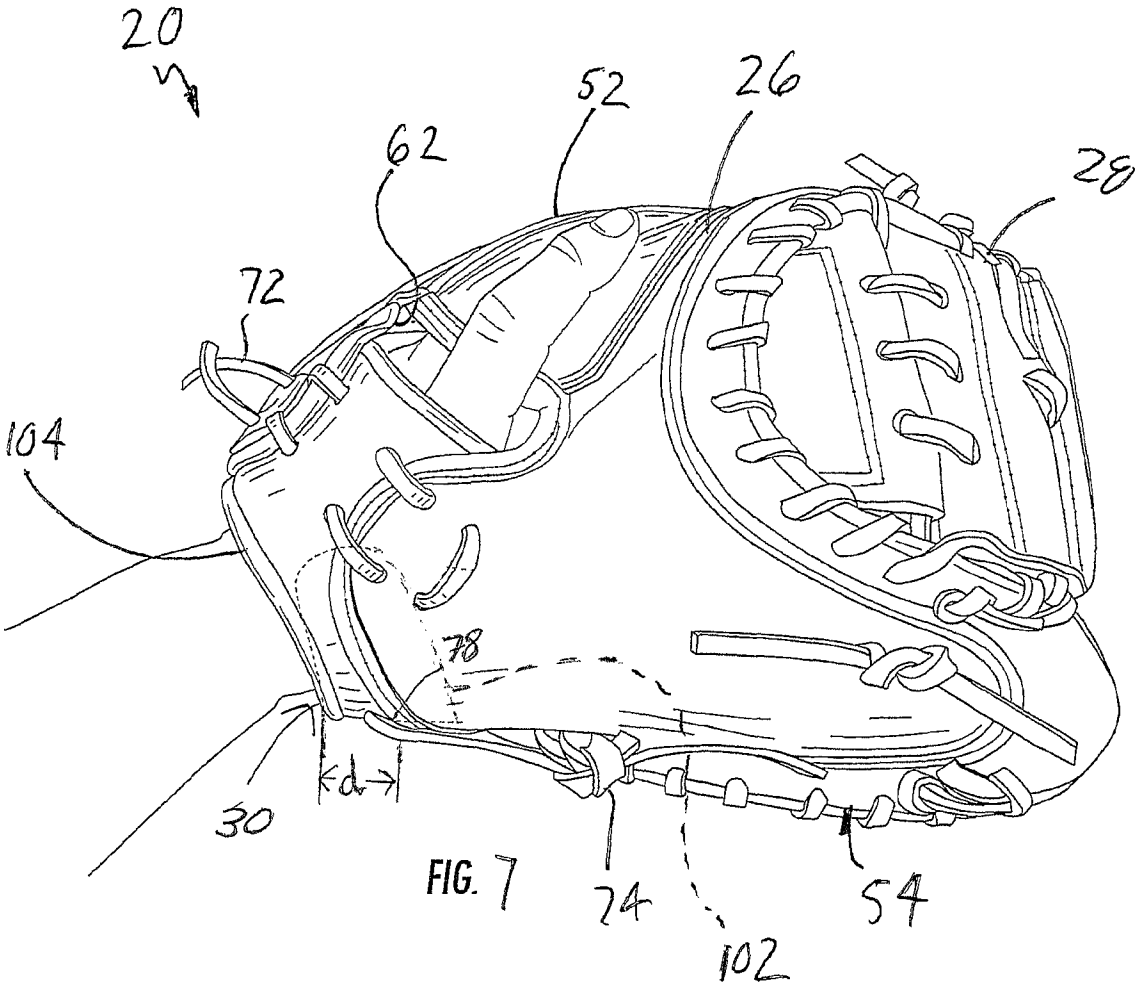
FIG. 7 is a rear perspective view of the glove of FIG. 1 illustrating positioning of a person's hand within the glove.

FIGS. 6 and 7 illustrate use of sling 30 as part of glove 20. FIG. 6 illustrates positioning of a person's hand with respect to sling 30 within glove 20, wherein regions of back glove portion 26 are omitted for purposes of illustration. FIG. 7 illustrates the person's hand inserted into glove 20 when glove 20 is held in the orientation shown in FIG. 1. As shown by FIG. 6, lacing 74 maintains flap 130 of thumb sleeve portion 106 in a curved or cylindrical configuration to form thumb sleeve 140. Thumb sleeve 140 forms a cylinder that receives the person's thumb. The size of the interior of thumb sleeve 140 is adjustable through loosing or tightening of lacing 74. The cross-sectional area or interior size of thumb sleeve 140 is smaller than the interior area or volume that would otherwise be provided by thumb stall 54, providing a snug fit or wrap with respect to the person's thumb to provide enhanced control of glove 20. Because thumb sleeve 140 is carried by or is formed as part of sling 30, thumb sleeve 140 assists in maintaining and stabilizing the person or players thumb and first metacarpal within glove 20 with respect to sling 30.

As further shown by FIG. 6, metacarpal support portion 102 underlies the skin 140 of the person's hand that is parallel to the first metacarpal and adjacent to the opponens pollicis extending alongside the first metacarpal along the side of the person's hand between a base of the person's thumb and wrist. Portion 102 further extends along the thenar emminence on the palm side of the person's hand between the base of the thumb and the wrist, when a person's thumb is positioned within glove 20.

As shown by FIG. 7, portion 102 curves or wraps about the skin 140 of the hand of the user. As shown by FIG. 7, wrist extension portion 104 wraps about a back side of the person's hand, across opening 62, where wrist extension portion 104 is releasably, and adjustably, secured to the pinky side of the back glove portion by lacing 72. In the example illustrated, wrist extension portion 104 has a width such that a portion of opening 62 remains open, allowing the person's index finger to pass through opening 62 along a back side of back portion 26 of glove 20. FIG. 7 also illustrates the sling 30 extending beyond a hand cavity edge 78 formed by the ends or edges of the front and back glove portions 24 and 26 defining the beginning of the hand cavity 50. The metacarpal support portion 102 of sling 30 extends from the hand cavity by a distance, d at the region of the portion 102 in line with the first metacarpal of the user. The distance d can be within the range of 0.5 to 3 inches. In one implementation, the distance d is within the range of 0.75 to 2.0 inches. The extension of the sling 30 by the distance d provides extra support to the catcher and helps to reduce fatigue, stress and strain to the catcher from repeated catches of pitched balls with the catcher's hand and wrist positioned in the positon of FIG. 7 or a similar position.

Overall, sling 30 supports the first metacarpal of a person's hand from the more stationary and stable upper edge of the person's hand extending from the base of the pinky to the wrist. Sling 30 assists in absorbing force and impact of the ball striking the glove 20 repeatedly over time. Sling 30 reduces fatigue and strain upon the first metacarpal the first metacarpal of the person's hand and the surrounding muscle and tissue.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements.

What is claimed is:

1. A ball glove for receiving a hand, thumb and at least a portion of a wrist of a person and for catching the ball, the ball glove comprising:

a front glove portion;

a back glove portion coupled to the front glove portion to define a hand cavity having a thumb stall, the thumb stall having a back side and a palm side; and a metacarpal sling extending within the hand cavity and extending at least partially within the thumb stall, the metacarpal sling coupled to the back glove portion at a first location on a pinky side of the back glove portion, the metacarpal sling extending along a back of the ball glove and coupled to the back glove portion at a second location adjacent the thumb stall, the metacarpal sling further extending around a thumb stall side of the ball glove to the palm side of the thumb stall, the metacarpal sling coupled to the front glove portion at a third location, the metacarpal sling configured to support a first metacarpal on the hand of the person when the hand is positioned within the hand cavity.

2. The ball glove of claim 1, wherein the metacarpal sling includes a thumb sleeve portion that wraps around the thumb of the hand of the person when the hand is inserted in the ball glove.

3. A ball glove for receiving a person's hand and for catching the ball, the ball glove comprising:

a front glove portion;

a back glove portion coupled to the front glove portion to define a hand cavity having a thumb stall, the thumb stall having a back side and a palm side; and a metacarpal sling extending within the hand cavity, the sling extending from a thumb side of the back glove portion to a pinky side of the back glove portion and continuing along the back side of the thumb stall to the palm side of the thumb stall so as to support the first metacarpal on the person's hand when the person's hand is positioned within the hand cavity wherein the metacarpal sling comprises:

a heel securement portion extending from the left side of the back glove portion toward the right side of the back to extend along part of a back of the person's hand when positioned within the hand cavity;

a metacarpal support portion extending from the heel securement portion to wrap about the first metacarpal of the hand of the person positioned within the hand cavity, wherein the heel securement portion has a first stiffness and wherein the metacarpal support portion has a second stiffness greater than the first stiffness; and a wrist extension portion extending from the metacarpal support portion over the back of the person's hand positioned in the hand cavity to adjustably engage the heel securement portion.

4. The ball glove of claim 3 comprising:

a continuous panel forming the heel securement portion and the metacarpal support portion; and a stiffening member secured to the continuous panel in a region of the metacarpal support portion.

5. The ball glove of claim 4, wherein the stiffening member comprises a pad.

6. The ball glove of claim 3, wherein the heel securement portion of the metacarpal sling has a second end connected to the end of the wrist extension portion.

7. The ball glove of claim 3, wherein the metacarpal sling further comprises a thumb sleeve extending within the thumb stall.

8. The ball glove of claim 1, wherein the metacarpal sling comprises a metacarpal support portion that extends over the opponens pollicis and the first metacarpal of the hand and wrist of the user when the person's hand is inserted within the ball glove.

9. The ball glove of claim 8, wherein the metacarpal support portion includes a layer of padding.

10. The ball glove of claim 1, wherein the metacarpal sling forms a secondary hand cavity within the cavity.

11. The ball glove of claim 1, wherein the pinky side of the back glove portion and a thumb side of the back glove portion are separated by an opening and wherein the metacarpal sling spans the opening.

12. The ball glove of claim 8, wherein other portions of the metacarpal sling have a first stiffness, and wherein the metacarpal support portion has a second stiffness that is greater than the first stiffness.

13. The ball glove of claim 4, wherein the stiffening member has a width along the thumb cavity, to extend parallel to the first metacarpal, of at least 1 inch.

14. The ball glove of claim 3, wherein the front and back glove portions define a hand cavity, wherein the front and back glove portions include a hand cavity edge, and wherein the second portion of the sling extends beyond the hand cavity edge at a location in line with the first metacarpal of the person's glove hand by a distance within the range of 0.5 to 3.0 inches.

15. A first metacarpal sling for insertion into a hand cavity of a ball glove for receiving a person's hand, the sling comprising:

a heel securement portion to be secured to a pinky side of a back portion of the ball glove, the heel securement portion has a first stiffness;

a metacarpal support portion extending from the heel securement portion, the metacarpal support portion dimensioned to extend across a front of the person's hand received within the hand cavity and to curl about an interior of a thumb stall of the ball glove about a first metacarpal and opponens pollicis of a person's hand when the person's hand is received within the hand cavity, the metacarpal support portion including a layer of padding, the metacarpal support portion having a second stiffness that is different from the first stiffness.

16. The sling of claim 15 further comprising a thumb sleeve to be inserted into the thumb stall and to receive a thumb of the person's hand.

17. The sling of claim 16, wherein the thumb sleeve comprises a flap and a strap extending from flap, wherein the strap holds the flap in a curled configuration to form thumb sleeve and wherein the strap is to extend through the back portion of the ball glove to secure the sling to the ball glove.

18. The sling of claim 16, wherein the heel securement portion comprises a plurality of spaced connection points for connection to the ball glove to adjust a spacing between the pinky side of the back glove portion and a thumb side of the back glove portion of the ball glove.

19. The sling of claim 15, wherein the second stiffness is greater than the first stiffness.

20. The sling of claim 15, further comprising a wrist extension portion extending from the metacarpal support portion over the back of the person's hand positioned in the hand cavity to adjustably engage the heel securement portion.

* * * * *